US011832058B2

(12) United States Patent
Diehl et al.

(10) Patent No.: US 11,832,058 B2
(45) Date of Patent: Nov. 28, 2023

(54) HEARING DEVICE SYSTEM AND METHOD FOR PROCESSING AUDIO SIGNALS

(71) Applicant: SONOVA AG, Staefa (CH)

(72) Inventors: Peter Udo Diehl, Berlin (DE); Elias Sprengel, Berlin (DE)

(73) Assignee: Sonova AG, Staefa (CH)

( * ) Notice: Subject to any disclaimer, the term of this patent is extended or adjusted under 35 U.S.C. 154(b) by 171 days.

(21) Appl. No.: 17/608,353

(22) PCT Filed: Apr. 9, 2020

(86) PCT No.: PCT/EP2020/060196
§ 371 (c)(1),
(2) Date: Nov. 2, 2021

(87) PCT Pub. No.: WO2020/224914
PCT Pub. Date: Nov. 12, 2020

(65) Prior Publication Data

US 2022/0256294 A1 Aug. 11, 2022

(30) Foreign Application Priority Data

May 9, 2019 (DE) ..... 10 2019 206 743.3

(51) Int. Cl.
*H04R 25/00* (2006.01)

(52) U.S. Cl.
CPC ..... *H04R 25/305* (2013.01); *H04R 25/507* (2013.01); *H04R 2225/39* (2013.01); *H04R 2225/55* (2013.01)

(58) Field of Classification Search
CPC .... H04R 25/505; H04R 25/507; H04R 25/55; H04R 25/552; H04R 25/554;
(Continued)

(56) References Cited

U.S. PATENT DOCUMENTS 5,754,661 A * 5/1998 Weinfurtner ..... H04R 25/507 706/2
10,492,008 B2 * 11/2019 Xu ..... H04R 25/507
(Continued)

FOREIGN PATENT DOCUMENTS

CN 105611477 A * 5/2016 ..... H04R 25/507
DE 102019200954 7/2020
(Continued)

OTHER PUBLICATIONS

International Search Report and Written Opinion received in International Application No. PCT/EP2020/060196.

*Primary Examiner* — Ryan Robinson
(74) *Attorney, Agent, or Firm* — ALG Intellectual Property, LLC

(57) ABSTRACT

A hearing device system and the method for processing audio signals are described. The hearing device system has at least one hearing device having a recording device for recording an input signal, at least one neural network for separating at least one audio signal from the input signal and a playback device for playing back an output signal ascertained from the at least audio signal. A calibration device is connected to the at least one hearing device in the data-transmitting manner. The at least one neural network is customizable and/or replaceable by the calibration device.

16 Claims, 2 Drawing Sheets

Figure 1:
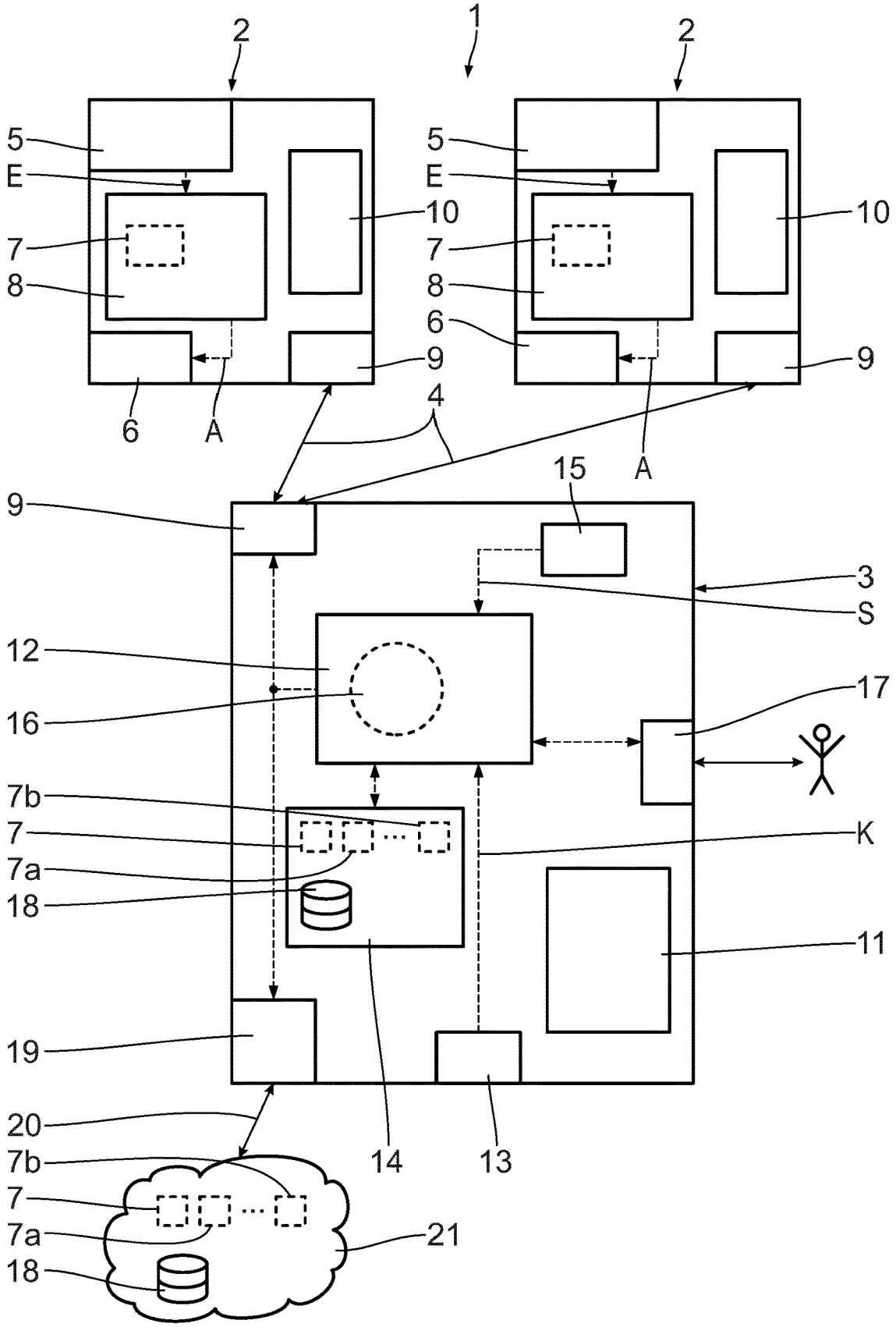

(58) Field of Classification Search
CPC ..... H04R 25/556; H04R 25/558; H04R 2225/41; H04R 2225/43; H04R 2225/55
See application file for complete search history.

(56) References Cited

U.S. PATENT DOCUMENTS

| | | | | |
|---|---|---|---|---|
| 11,270,198 | B2 * | 3/2022 | Busch | H04R 25/507 |
| 11,503,414 | B2 * | 11/2022 | Jensen | H04R 25/507 |
| 11,540,063 | B2 * | 12/2022 | Pedersen | G06N 3/08 |
| 2017/0061978 | A1 * | 3/2017 | Wang | G10L 21/0232 |
| 2018/0227682 | A1 | 8/2018 | Lederman | |
| 2019/0182606 | A1 * | 6/2019 | Petersen | A61B 5/291 |
| 2019/0222943 | A1 * | 7/2019 | Andersen | H04R 25/507 |
| 2021/0260377 | A1 * | 8/2021 | Eder | H04R 25/606 |
| 2021/0321208 | A1 * | 10/2021 | Cumming | H04R 25/70 |
| 2022/0124444 | A1 * | 4/2022 | Andersen | H04R 25/507 |

FOREIGN PATENT DOCUMENTS

| | | |
|---|---|---|
| DE | 102019200956 | 7/2020 |
| EP | 3229496 | 10/2017 |
| EP | 3079378 | 11/2018 |
| EP | 3082350 | 2/2019 |
| EP | 3236675 | 1/2020 |
| WO | WO-2020177371 A1 * | 9/2020 |

* cited by examiner

HEARING DEVICE SYSTEM AND METHOD FOR PROCESSING AUDIO SIGNALS

The present application claims priority of German patent application DE 10 2019 206 743.3 the content of which is incorporated herein by reference.

The inventive technology relates to a hearing device system for processing audio signals. The inventive technology moreover relates to a method for processing audio signals.

BACKGROUND

Hearing device systems having at least one hearing device and methods for processing audio signals are known from the prior art.

DETAILED DESCRIPTION

It is an object of the present inventive technology to provide a hearing device system that is used to improve processing of audio signals. In particular, the aim is for the quality of the processing of the audio signals to be improved given simultaneously low latency.

This object is achieved by a hearing device system having the features specified herein. The hearing device system has at least one hearing device and a calibration device connected to the at least one hearing device in a data-transmitting manner. The hearing device has a recording device for recording an input signal, at least one neural network for separating at least one audio signal from the input signal and a playback device for playing back an output signal ascertained from the at least one audio signal. The at least one neural network is customizable and/or replaceable by the calibration device. At this juncture and below, the term "neural network" must be understood to mean an artificial neural network.

Here and in the following, the term "signal processing" generally refers to modifying and/or synthesizing signals. A subset of signal processing is "sound enhancement", which can comprise "speech enhancement". Sound enhancement generally refers to improving intelligibility or ability of a listener to hear a particular sound. For example, speech enhancement refers to improving the quality of speech in a signal so that a listener can better understand the speech.

The essence of the inventive technology is functional separation of signal processing on the at least one hearing device, on the one hand, and replacement and/or customization of the at least one neural network of the at least one hearing device by the calibration device, on the other hand. The replacement and/or customization of the at least one neural network can be regarded as part of a calibration of the at least one hearing device by the calibration device. The actual processing of the audio signals, namely the recording of an input signal, the separation of one or more audio signals from the input signal and the playing back of the output signal ascertained from the at least one audio signal, is performable solely by the at least one hearing device. A transmission of signals from the at least one hearing device to external devices is not necessary for the signal processing. This ensures minimal latency for the signal processing. The playback of the output signal is effected more or less in real time, that is to say with minimal delay after the input signal is picked up. This avoids perturbing delays and/or echo effects. The signal processing is efficient. The maximum latency for the processing of the audio signals is in particular shorter than 40 ms, in particular shorter than 20 ms, preferably shorter than 10 ms. An exemplary latency for the processing of the audio signals is between 10 ms and 20 ms.

The customizability or replaceability of the at least one neural network by the calibration device moreover ensures customization of the system to the respective requirements. Reliable processing of the input signal is ensured even under changing conditions. Preferably, the customization and/or replacement of the at least one neural network by the calibration device are effected automatically and/or dynamically. Independently of the customizability and/or replaceability of the at least one network, a customizability of the signal processing by the at least one hearing device by means of the calibration device is a separate aspect of the inventive technology.

The functional separation also has the advantage, in particular, that the signal processing by the at least one hearing device can be restricted substantially to the execution of the at least one neural network. The at least one hearing device preferably executes at least one neural network specializing in the respective instance of application. Specialized neural networks are distinguished in particular by very low hardware requirements. The execution of at least one neural network, in particular at least one specialized neural network, is possible with little computational complexity and low power consumption. This increases the efficiency of the method further. Operation of the at least one hearing device is ensured for a long time even when the capacity of the power supply thereof is low. Computationally complex operations, which may be necessary for calibrating the at least one hearing device, for example, are performable by the calibration device, in particular. Computationally complex operations are effected by the calibration device preferably asynchronously in relation to the signal processing by the at least one hearing device. Negative influences of computationally complex operations of this kind on the latency of the signal processing are avoided. Computationally complex operations can be performed by the calibration device without adversely affecting the computing power or the power consumption of the at least one hearing device. The hearing device system can in particular use a higher computing power of the calibration device in comparison with the at least one hearing device in order to improve the quality of the signal processing by means of the calibration.

As an alternative or in addition to the signal processing by the at least one hearing device, the separation and/or processing of the at least one audio signal may be performable at least in part on the calibration device. This is advantageous in complicated hearing situations, in particular. The quality of the signal processing can be ensured regardless of the hearing situation.

The at least one neural network of the at least one hearing device allows high-quality, user-specific signal processing. The input signal corresponds to a soundscape recorded by using the at least one recording device. The input signal normally comprises an unknown number of different audio signals. The different audio signals can originate in particular from different sound sources, for example interlocuters, passing cars, background music and/or the like. Preferably, the separation of one or more audio signals from the input signal by using the at least one neural network is effected in source-specific fashion. In this case, the audio signal of a specific sound source, for example an interlocutor, is separated from the input signal. Particularly preferably, multiple audio signals are separated from the input signal. In this manner, the audio signals of different sound sources can be processed independently of one another. This allows selective processing and weighting of the individual audio signals. By way of example, the audio signal of an interlocutor can be amplified, while the conversations of people nearby are rejected. The processing of the audio signals is possible in source-specific fashion.

The wording "output signal ascertained from the at least one audio signal" must be understood in particular to mean that the output signal contains at least portions of the at least one audio signal. The output signal can correspond to the at least one audio signal, for example. Preferably, the output signal is ascertained by virtue of the at least one audio signal being combined with further audio signals and/or other portions of the input signal. By way of example, multiple output signals separated from the input signal can be combined to form the output signal. Preferably, the at least one audio signal is modulated to ascertain the output signal. The at least one audio signal can be amplified and/or rejected. Different audio signals can be modulated differently. The modulation of an audio signal is preferably effected on the basis of a priority parameter. The priority parameter can be ascertained and/or prescribed by the calibration device, for example.

Herein, the term "modulation" can in general include any changes to the power spectrum of the audio signals. It comprises the application of specific gain models and/or frequency translations, also referred to as transpositions, and/or sound enhancement modulation, in particular clean-up steps, more particularly speech clean-up steps. Individual audio signals may be amplified or enhanced while others may be suppressed. Preferably, different gain models might be used to amplify specific audio signals. Specifically, modulation of the audio signal may comprise frequency translation of the audio signals. By frequency translation at least some parts of audio signals in particular certain frequency ranges or components contained therein, can be transposed to different frequencies. For example, frequency translation can be used to translate frequencies, which a user cannot hear, into frequencies, which the user can hear. Preferably, the frequency translation can be used to translate inaudible parts of the audio signal, e.g. high frequencies, into audible audio signals. This is particularly advantageous when the signal processing device is used for audio signal processing for at least one hearing device.

Preferably, the signal processing device comprises gain model algorithms and/or frequency translation algorithms. Such algorithms may be stored on a computer-readable medium and may be executed by a computing unit of the signal processing device.

The computer-readable medium may be a non-transitory computer-readable medium, in particular a data memory. An exemplary data memory is a hard drive or a flash memory. The hearing device system, in particular the hearing device system and/or the calibration device and/or the signal processing device, more generally the signal processing device preferably comprises the computer-readable medium. The hearing device system, in particular the hearing device and/or the calibration device, more generally the signal processing device may additionally or alternatively be in data connection with an external computer-readable medium on which the at least one neural network is stored. The hearing device system, in particular the hearing device and/or the calibration device, more generally the signal processing device may comprise a computing unit for accessing the computer-readable medium and executing the neural networks stored thereon. The computing unit may comprise a general processor adapted to perform arbitrary operations, e.g. a central processing unit (CPU). The computing unit may alternatively or additionally comprise a processor specialized on the execution of the at least one neural network, in particular the first neural network and/or the at least one second neural network. Preferably, the computing unit may comprise an AI chip for executing the at least one neural network, in particular the first neural network and/or the at least one second neural network. AI chips can execute neural networks efficiently. However, a dedicated AI chip is not necessary for the execution of the at least one neural network.

By using the calibration device, the at least one neural network is customizable to the respective instance of application. The at least one neural network is customizable in particular to the respective input signal and/or to the at least one audio signal to be separated from the respective input signal. For the purpose of customization, operating parameters corresponding to the respective instance of application may be transmittable from the calibration device to the at least one hearing device, for example. The at least one neural network may be designed to perform specific processing steps corresponding to the operating parameters. Such operating parameters for neural networks are also referred to as vectors. The vectors can contain parameters corresponding to individual audio data, in particular to individual speakers. The at least one neural network renders for example a specific number of vectors useable as input parameters. By means of the vectors used as input parameters, it is in particular stipulatable that only audio signals corresponding to the respective vectors are supposed to be separated from the input signal and/or processed during the signal processing.

The vectors are in particular calculable on the calibration device, preferably calculable on the basis of the respective hearing situation. The vectors are for example calculable by the calibration device on the basis of the type of sound sources, such as for example speakers or vehicles, and/or the number of sound sources, for example the number of speakers. The vectors are in particular calculable by using at least one neural calibration network of the calibration device. The calculation of the vectors is for example performable on the basis of previously recorded audio data, in particular a calibration input signal.

The customizability of the at least one neural network is in particular advantageous if the at least one hearing device has an application-specific integrated circuit (ASIC) for executing the at least one neural network. In this case, the hardware of the at least one hearing device may be optimized for the execution of the at least one neural network. The at least one network is executable efficiently and in power-saving fashion. The customization of the at least one neural network renders weights within the network customizable to the respective requirements. The structure of the at least one neural network can be preserved during the customization.

The at least one neural network is additionally or alternatively replaceable by the calibration device. In particular, the calibration device can determine a neural network that is particularly well suited to the respective instance of application. A neural network of the at least one hearing device can be replaceable by the neural network suitable for the instance of application by using the calibration device. The replacement of the at least one neural network in particular also renders the structure of the network as customizable.

The calibration device is connected to the at least one hearing device in a data-transmitting manner. To customize the signal processing on the at least one hearing device, in particular and/or to replace the at least one neural network, the calibration device in particular transmits a transmission signal to the at least one hearing device. The transmission signal has for example operating parameters for customizing the signal processing, in particular operating parameters for customizing the at least one hearing device, in particular vectors. Additionally or alternatively, the transmission signal can have operating parameters for replacing the at least one neural network, in particular the at least one neural network to be replaced itself. Additionally or alternatively, the transmission signal can also have audio data used for customizing the signal processing by the at least one hearing device. Audio data that the transmission signal contains are alternatively reproducible by the playback device of the at least one hearing device as part of the output signal too. The transmission signal can generally have audio data, operating parameters, in particular vectors, and/or neural networks.

The customization and/or replacement of the at least one neural network can be effected on the basis of the type of input signal, i.e. the respective soundscape characteristic of the instance of application. By way of example, different neural networks can be taken into consideration for different instances of application, for example soundscapes of a railway station, restaurant and/or road noise. Depending on the type of input signal, different audio signals can also be separated. If the user is in a railway station, for example, audio signals of an interlocutor, arriving trains and/or from station announcements can be separated from the input signal. In particular, the customization and/or replacement of the at least one neural network are dependent on the number of audio signals to be separated from the input signal. By way of example, different neural networks can be used if a different number of speakers and/or background noise is supposed to be separated from the input signal. By way of example, it is possible for only one speaker to be characterized as relevant and for the applicable audio signal to be separated from the input signal. Alternatively, it is also possible for all voice signals that the input signal contains from different speakers to be separated from the input signal as individual audio signals.

The customization and/or replacement of the at least one neural network by the calibration device is effected in particular on the basis of an evaluation of a calibration signal by the calibration device. The calibration signal can comprise sensor data, clips from the input signal and/or audio data recorded by the calibration device itself. By way of example, the calibration signal can have sensor data from sensors of the calibration device, in particular of a GPS sensor and/or motion sensor. The customization or replacement of the at least one neural network can then be effected on the basis of the location and/or the motion profile of the user. If for example it is evident on the basis of the sensor data that the user is in a railway station, the at least one network can be customized to typical station sounds and/or replaced with a neural network optimized for station sounds. To determine the whereabouts of the user, it is also possible to use network information, for example known WLAN access points, and/or radio cell information, in particular triangular direction-finding by using different mobile phone network towers.

Preferably, the calibration signal comprises a clip from the input signal and/or audio data recorded by the calibration device. Particularly preferably, the calibration signal comprises audio data recorded by the calibration device. A calibration signal comprising audio data is subsequently also referred to as a calibration input signal. A calibration signal having audio data has the advantage that the customization or replacement of the at least one neural network is effected on the basis of the signal to be processed. By way of example, the calibration device itself can separate at least one audio signal from a clip from the input signal and/or from a calibration input signal recorded by using the calibration device, in order to take the type of separated audio signals as a basis for determining the neural network optimally suited thereto and/or operating parameters optimally suited thereto. In particular, a plurality of audio signals are separable from the calibration input signal. The analysis of the calibration input signal preferably renders the number of relevant audio signals, in particular the number of relevant speakers, automatically determinable. The selection and/or customization of the at least one neural network are possible on the basis of the number of relevant audio signals.

The calibration input signal used can be for example audio data recorded over a period of time. By way of example, audio data are recorded over several seconds or several minutes as a calibration input signal. The analysis of the calibration input signal renders for example vectors corresponding to sound sources, in particular speakers, that have been recorded over the period of time calculable.

The calibration input signal is in particular recordable by the calibration device. In this case, the calibration input signal normally differs from the input signal recorded by the at least one hearing device. Since the calibration device is normally close to the at least one hearing device, however, the calibration input signal comprises substantially the same audio signals as the input signal. The analysis of the calibration input signal therefore allows conclusions to be drawn about the input signal, in particular the type thereof and the audio signals contained therein.

Preferably, the at least one neural network is deactivatable and activatable by the calibration device. In particular, the at least one neural network is temporarily deactivatable. When the at least one neural network is deactivated, in particular no splitting of the input signal into at least one output signal takes place. The input signal can be directly amplifiable when the at least one neural network is deactivated. The output signal may in particular correspond to the amplified input signal. This is in particular advantageous in simple hearing situations in which only individual sound sources exist. If the user is talking to one or a few interlocutors in otherwise quiet surroundings, for example, it may suffice to amplify the input signal. The temporary deactivation of the at least one neural network allows energy consumption to be lowered without adversely affecting the quality of the signal processing for the user. The efficiency of the system is increased. The at least one neural network is in particular automatically reactivatable by the calibration device, in particular activatable with suitable customizations. As a result, the hearing device system is flexibly customizable to changing hearing situations, for example to the addition of further sound sources.

The hearing device system can have a single hearing device. Preferably, the hearing device system has two hearing devices associated with the respective ears of a user. In the case of multiple hearing devices, the signal processing by each of the hearing devices is in particular independent. Each hearing device can record a slightly different input signal on the basis of the different position in the room. The input signals of each hearing device can be processed as appropriate, so that the spatial information is preserved.

When there are a plurality of hearing devices, the signal processing on each of the hearing devices is preferably performable independently. In particular when there are two hearing devices, spatial information is therefore obtainable and outputtable to the user. Alternatively, the signal processing is performable in a manner distributed over the hearing devices. To this end, data can be interchangeable between the individual hearing devices. By way of example, it is possible for just one of the hearing devices to be used for separating the audio signals. The separated audio signals or the output signal determined therefrom can then be transmitted to further hearing devices. In the latter case, the further hearing devices can output the same output signal as the hearing device performing the separation, or can perform further processing of the conveyed audio signals.

A hearing device within the context of the present inventive technology can be a wearable hearing device or an implantable hearing device or a hearing aid with implants. An implantable hearing device is for example a middle-ear implant, a cochlear implant or a brainstem implant. A wearable hearing device is for example a behind-the-ear device, an in-the-ear device, a spectacle hearing aid or a phone conduction hearing device. A wearable hearing device can also be suitable headphones, for example what is known as a hearable or smart headphones. In general, the hearing device used can be a signal processing device having the recording device, the at least one neural network and the playback device. A separate aspect of the inventive technology is also a signal processing system having a signal processing device that has a recording device for recording an input signal, at least one neural network for separating at least one audio signal from the input signal and a playback device for playing back an output signal ascertained from the at least one audio signal, and a calibration device, wherein the at least one neural network of the signal processing device is customizable and/or replaceable by the calibration device.

The calibration device and the at least one hearing device are in particular independent of one another. They have in particular independent hardware components. In particular, the at least one hearing device and the calibration device each have independent computer units, in particular processors and main memories. The hardware of the at least one hearing device can be tailored to the processing of audio signals in this case. In particular, the at least one hearing device can have a processor specializing in the execution of the at least one neural network, what is known as an AI chip. Such an AI chip of the at least one hearing device has for example a computing power of 100 megaflops, in particular 1 gigaflop, in particular 2 gigaflops, in particular 4 gigaflops. A computer power of more than 4 gigaflops is also possible.

According to one preferred aspect of the inventive technology, the calibration device and the at least one hearing device each have a power supply of their own. In particular, the power supplies of the calibration device and the at least one hearing device are each in the form of a storage battery. The at least one hearing device and the calibration device are suppliable with power, an operable, independently of one another, in particular. After the at least one hearing device has been calibrated once by customizing and/or replacing the at least one neural network, the at least one hearing device can continue to be useable independently of the calibration device. A possibly low state of charge of the power supply of the calibration device does not adversely affect the further signal processing by the at least one hearing device. The relocation of computationally complex operations, in particular computationally complex operations for the analysis of a calibration signal, to the calibration device allows the operating time of the at least one hearing device to be extended. The hearing device system is employable reliably and in mobile fashion.

According to a further advantageous aspect of the inventive technology, the calibration device and the at least one hearing device are connected by means of a wireless data connection. A physical data connection, for example by means of a cable, is not necessary. For wireless data connections, the functional split according to the present inventive technology has been found to be particularly advantageous, since wireless data connections have particularly high latencies. The hearing device system allows a high gain in efficiency. The wireless data connection can be realized using a wide variety of connection standards and protocols. Particular suitability has been found in Bluetooth connections or similar protocols, such as for example Asha Bluetooth. Further exemplary wireless data connections are FM transmitters, aptX LL and/or induction transmitters (NFMI) such as the Roger protocol.

According to a further advantageous aspect of the inventive technology, the calibration device is in the form of a mobile device, in particular in the form of part of a mobile phone. This ensures a high level of flexibility from the hearing device system. Here and in the following, mobile phone means in particular a smartphone. Modern mobile phones have a high computing power and storage battery capacity. This allows independent operation of the hearing device system, in particular even for computationally complex operations by the calibration device. Moreover, this has the advantage that the hearing device system is realizable by hardware that a user carries anyway. Additional devices are not necessary. It is furthermore advantageous that the user, owing to the functional split according to the inventive technology, can use the computing power of the mobile phone for other activities completely without the signal processing by the at least one hearing device being limited.

According to a further advantageous aspect of the invention, the calibration device is in the form of a mobile device, in particular in the form of part of a wireless microphone. Wireless microphones are assistive listening devices used by hearing impaired persons to improve understanding of speech in noise and over distance, such as the Roger Select microphone manufactured by Phonak AG. Wireless microphones can be equipped with sufficient computing power as needed for running a neural network, possibly using a co-processor dedicated to the neural network execution. This allows independent operation of the hearing device system, in particular even for computationally complex operations by the calibration device. Moreover, this has the advantage that the hearing device system is realizable by hardware that a user carries anyway. Additional devices are not necessary. It is furthermore advantageous that the user, owing to the functional split according to the invention, can use the computing power of the mobile phone for other activities completely without the signal processing by the at least one hearing device being limited.

In particular when the calibration device is embodied as part of a mobile phone, it is advantageous if the at least one hearing device has a power supply of its own. If the storage battery state of charge of the mobile phone is low, the at least one hearing device can continue to be used.

A calibration device embodied as part of a mobile phone may be realized by components of the mobile phone. Particularly preferably, the normal hardware components of the mobile phone are used for this purpose by virtue of an applicable piece of calibration software, for example in the form of an app, being installable and executable on the mobile phone. By way of example, an analysis of the calibration signal can be carried out by using a computing unit of the mobile phone, in particular an AI chip of the mobile phone. Established mobile phones have AI chips having 2 or more teraflops, for example 5 teraflops. A calibration input signal can be recorded by using the at least one microphone of the mobile phone.

Particularly preferably, the hearing device system may be of modular design. This ensures flexible customization of the hearing device system to the respective user preferences. Individual components of the hearing device system are replaceable, in particular in the event of a fault. By way of example, the user can use a mobile phone as a calibration device following installation of an appropriate app. The user can replace individual instances of the hearing devices and/or the mobile phone used as a calibration device.

The at least one neural network can output a variable number of audio signals. Preferably, the at least one neural network has a fixed number of outputs. For the signal processing of the at least one hearing device, the use of one neural network is sufficient. In other instances of application, the at least one hearing device can also have a plurality of neural networks in each case. When multiple neural networks are used for separation, each one can have a fixed number of outputs. In this case, each neural network used for separating audio signals outputs a fixed number of audio signals separated from the input signal. The number of separated audio signals can therefore be based on the number of neural networks used for separation and the respective number of outputs. By way of example, all neural networks can have three outputs. The number of audio signals separated from the input signal by using the at least one neural network is preferably stipulatable in flexible fashion.

Before the audio signals are separated from the input signal, the input signal can be conditioned in a preparation step. The preparation step can be effected conventionally and/or by using at least one neural conditioning network. Particularly preferably, the neural conditioning network is part of the at least one neural network that is customizable and/or replaceable by means of the calibration device.

For the at least one neural network, it is possible for different network architectures to be used. The architecture used for the neural networks is not significant for the separation and further processing of the audio signals from the input signal. Particular suitability has been found in long short-term memory (LSTM) networks, however. In one exemplary architecture, the at least one neural network has 3 LSTM layers having 256 units each.

According to one advantageous aspect of the inventive technology, the at least one neural network is selectable from a plurality of different neural networks by means of the calibration device. In particular, a neural network specifically customized to the respective instance of application is selectable in each case by using the calibration device. The signal processing by the at least one hearing device is effected in particular substantially by executing the at least one neural network customized to the respective instance of application. The execution of at least one neural network customized, in particular optimally customized, to the instance of application is possible with little computational complexity and low power consumption. The method is particularly efficient.

The different neural networks are preferably customized to different types of input signals and/or different audio signals to be separated therefrom. Different neural networks selectable by using the calibration device specialize in particular in the separation of different types of audio signals from the same type of input signal. By way of example, different neural networks can be selected by using the calibration device, in order to separate different audio signals, such as for example approaching vehicles and/or interlocutors, from the same input signal. Advantageously, at least one neural network customized to the respective instance of application is selectable by the calibration device. The neural network executed by the at least one hearing device can be replaced by a neural network, selected by the calibration device, that is better customized to the instance of application. The hearing device system is flexibly calibratable.

The customization of different neural networks to different types of input signals and/or audio signals is effected in particular by training the neural networks, for example on the basis of data records containing such audio signals. The training allows the neural networks to be customized in particular to different situation-dependent types of audio signals. The training can be effected in particular on the basis of the hardware of the at least one hearing device, in particular by the recording device. The training can be effected using different vectors, in particular using changing vectors. This improves the quality and robustness of the at least one neural network. The training can be effected over a long period of time. By way of example, the training can result in 10 million updates, in particular 50 million, in particular 100 million updates, in particular more than 100 million updates, of the weights of the at least one neural network being effected.

According to a further advantageous aspect of the inventive technology, the different neural networks for separating audio signals are transmittable from the calibration device to the at least one hearing device. The different neural networks do not need to be stored on the at least one hearing device. The at least one hearing device therefore does not need to have a large memory for different neural networks. Particularly preferably, only the at least one neural network that is currently to be used for separation is stored on the at least one hearing device, in particular loaded into a main memory of the at least one hearing device, in each case.

The selectable different neural networks are stored in a data memory of the calibration device, for example. The neural networks may be stored for example in the data memory of a mobile phone used as a calibration device. Modern mobile phones have a large storage capacity. As a result, a large number of different neural networks are storable. In particular, different neural networks are storable that are customized to the same hearing situation but are consistent with different hearing profiles. By way of example, different neural networks can perform filtering and/or processing of the audio signals to a greater or lesser extent. The selection of the at least one neural network is not only situation-dependent but also performable on the basis of the preferences of the user. Additionally or alternatively, the different neural networks available for selection may also be stored outside the calibration device. Particularly preferably, the different neural networks may be stored in a cloud memory to which the calibration device has access. Depending on the instance of application, different possible relevant neural networks from the cloud memory can also be buffer-stored on the calibration device in order to reduce a latency for the transmission of the selected neural network.

According to a further advantageous aspect, the calibration device has at least one neural calibration network for processing a calibration signal.

The neural network can be stored on a computer-readable medium, in particular a non-transitory computer-readable medium, in particular a data memory. An exemplary data memory is a hard drive or a flash memory. The signal processing device preferably comprises the computer-readable medium. The signal processing device may additionally or alternatively be in data connection with an external computer-readable medium on which the neural network is stored. The signal processing device may comprise a computing unit for accessing the computer-readable medium and executing the neural networks stored thereon. The computing unit may comprise a general processor adapted to perform arbitrary operations, e.g. a central processing unit (CPU). The computing unit may alternatively or additionally comprise a processor specialized on the execution of the neural network. Preferably, the computing unit may comprise an AI chip for executing the neural network. AI chips can execute neural networks efficiently. However, a dedicated AI chip is not necessary for the execution of the neural network.

Preferably, the details of the neuronal network and/or the modulation-functions used to modulate the audio signals, the gain models used to be applied to the audio signals can be modified, e.g., exchanged, by providing different neuronal networks and/or modulation-functions on computer readable media. By that, the flexibility of the system is enhanced. Furthermore, it is possible to refit existing systems, in particular existing hearing devices with the processing capability according to the present inventive technology.

By using the at least one neural calibration network, in particular a calibration input signal containing audio data, in particular a calibration input signal recorded by using the calibration device, may be evaluable. The at least one neural calibration network can be used to separate individual audio signals from the calibration input signal. The at least one calibration network can be used to determine the type of calibration input signal or the type of audio signals contained therein. The neural network optimally useable for the respective input signal or the audio signals to be separated therefrom is determinable simply and reliably. In particular, the number of audio signals that the calibration input signal contains is determinable. It is therefore possible for a neural network useable for separating precisely this number of audio signals to be selected. By using the at least one neural calibration network, in particular vectors by means of which the at least one neural network of the at least one hearing device is customizable are calculable.

Particularly preferably, the analysis of the calibration input signal also results in a relevance of the audio signals separated from the calibration input signal to the user being ascertained. As a result, it is possible to ensure that only the audio signals relevant to the user are separated from the input signal by using the at least one neural network. If the calibration input signal has for example a multiplicity of voices but only some of these are relevant to the user, it is possible for a description of the relevant voices in the form of an operating parameter to be created and to be transmitted from the calibration device to the at least one hearing device for the purpose of customizing the at least one neural network. Moreover, a priority parameter can be stipulated in line with the relevance of the respective audio signals to the user. The priority parameter may be transmittable to the at least one hearing device as part of the operating parameters in order to customize the at least one neural network such that the applicable audio signal is selectively modulable, i.e. selectively amplifiable or suppressible, when the output signal is ascertained.

According to a further preferred aspect of the inventive technology, the calibration device has a calibration recording device for recording audio data as part of the calibration signal. The calibration recording device can comprise one or more microphones of the calibration device. In particular if the calibration device is in the form of part of a mobile phone, the calibration recording device can use the at least one microphone of the mobile phone. Modern mobile phones have different microphones in order to be able to record stereo information. The different microphones also allow spatial information to be obtained by the calibration input signal.

The provision of a calibration recording device has the advantage that audio data are analysable by using the calibration device without it being necessary for an input signal to be transmitted from the at least one hearing device to the calibration device. The customization and/or replacement of the at least one neural network is preferably effected on the basis of the analysis of the recorded audio data.

According to a further preferred aspect of the inventive technology, the calibration device has a user interface for receiving user inputs and/or for outputting information to a user. The user interface is preferably in the form of a touchscreen. Information is displayable to the user simply and comprehensibly on a touchscreen. Inputs by the user are possible intuitively and directly. The provision of the user interface allows the user to influence the customization and/or replacement of the at least one neural network by means of the calibration device. By way of example, the user can stipulate the number of audio signals to be separated from the input signal. The signal processing by the at least one hearing device is flexibly and dynamically customizable to the preferences and needs of the user. The user interface can be used to output in particular information about the separated audio signals to the user. By way of example, a transcript of an audio signal can be displayed to the user. The user can then read statements that he may not have understood, for example.

It is a further object of the inventive technology to improve a method for processing audio signals. In particular, the aim is to specify a method having latencies that are as low as possible.

This object is achieved by a method having the steps specified herein. First of all, a hearing device system, in particular a hearing device system as described above, is provided. The provided hearing device system has a calibration device and at least one hearing device having at least one neural network for separating at least one audio signal from the input signal, wherein the calibration device and the at least one hearing device are connected in a data-transmitting manner. Moreover, a calibration signal is provided. The calibration signal is evaluated by the calibration device. The analysed calibration signal is taken as a basis for replacing and/or customizing the at least one neural network of the at least one hearing device by means of the calibration device. An input signal is recorded by using a recording device of the at least one hearing device. The at least one neural network of the at least one hearing device is used to separate at least one audio signal from the input signal. An output signal is ascertained from the at least one audio signal, said output signal being output by means of a playback device of the at least one hearing device.

The method according to the inventive technology involves the at least one hearing device being calibrated by the calibration device by virtue of the latter replacing and/or customizing the at least one neural network of the at least one hearing device. The replacement and/or customization are effected on the basis of an analysed calibration signal. The analysis of the calibration signal, which analysis can involve computationally complex operations, is effected completely on the calibration device. The actual signal processing by using the at least one neural network is effected completely by the at least one hearing device. This allows the signal processing on the at least one hearing device to be performed with little computational complexity and low power consumption. A transmission of the input signal to an external signal processing apparatus is not necessary. The latency for the processing of the audio signals is reduced. The signal processing is efficient. Particularly preferably, the at least one neural network is deactivatable and activatable, in particular temporarily deactivatable, by the calibration device. The further advantages of the method correspond to the advantages of the hearing device system according to the inventive technology.

The separation of individual or multiple instances of the audio signals means that they can advantageously be modulated separately in the method. This allows independent and flexible processing, in particular independent and flexible modulation, of the individual audio signals. The processing of the at least one audio signal and in particular the output signal ascertained therefrom are individually customizable to the respective user. The modulation is preferably effected on the basis of a priority parameter. The priority parameter is particularly preferably stipulated by the calibration unit on analysis of the calibration signal. The priority parameter may be transmittable as an operating parameter from the calibration device to the at least one hearing device and can be used to customize the at least one neural network. The priority parameter conveys in particular a relevance of the respective audio signal to the user. Relevant audio signals are provided with a high priority parameter, for example, and are amplified accordingly. Less relevant audio signals are provided with a low priority parameter, for example, and are not amplified or are rejected. Particularly preferably, the priority parameter is continuous, so that continuous customization of the modulation to the relevance of the respective audio signal and/or to the preferences of the user can be effected. By way of example, the priority parameter can be between 0 and 1. The lowest relevance is then possessed by for example audio signals having the priority parameter 0, which would be rejected completely. The highest priority is then possessed by for example audio signals having the priority parameter 1, which would bring about a maximum gain for the audio signal. Alternatively, the priority parameter may also be discrete, so that the different audio signals are categorized into different classes.

The customization and/or replacement of the at least one neural network can be effected at the beginning of the method. Particularly preferably, the calibration device repeatedly performs analyses of further calibration signals. Depending on the further analysis, further customization and/or further replacement of the at least one neural network by the calibration device may be effected. The calibration device checks, in particularly automatically, whether customization and/or replacement of the at least one neural network are necessary. The at least one hearing device is dynamically and flexibly calibratable. The hearing device system is flexibly customizable to changing use scenarios. Particularly preferably, a check by the calibration device, in particular an analysis of a further calibration signal, and if need be the customization and/or replacement are effected at regular intervals. The check can be effected up to once every 5 milliseconds. The check can also be effected only once per second. Preferably, the check is effected no less often than once every 10 minutes. The checking rate can be varied, preferably dynamically, between once every 5 milliseconds and once every 10 minutes.

According to a further advantageous aspect of the method, the analysis of the calibration signal is effected by using at least one neural calibration network. In particular, the at least one neural calibration network is used to analyse a calibration signal containing audio data, or a calibration input signal. The at least one neural calibration network is preferably used to separate one or more audio signals from a calibration input signal. The at least one neural calibration network can be used to evaluate in particular the type of calibration input signal and the audio signals contained therein.

According to a further preferred aspect of the method, the calibration device selects the at least one neural network from an available set of neural networks. Different instances of the available neural networks can be customized to different types of input signals and/or different audio signals to be separated therefrom, as described above with reference to the hearing device system. The calibration device can take the analysis of the calibration signal as a basis for selecting the neural network optimally customized to the input signal and/or the audio signals to be separated therefrom. The available set of neural networks is preferably stored on the calibration device and/or on an external cloud memory.

According to a further advantageous aspect of the method, the selected neural network is transmitted from the calibration device to the at least one hearing device. Preferably, in each case only the at least one neural network used for separation is stored on the hearing device, in particular in a main memory of the hearing device. The calibration device is used in particular as an extendable and easily accessible memory for the at least one hearing device. Alternatively or additionally, the useable neural networks are saved on an external cloud memory. The provision of a large data memory on the at least one hearing device is not necessary. Additionally, preferences of the user and/or types of audio signals known to him, for example voice profiles, may be stored on the data memory of the calibration device and/or on the cloud memory.

According to a further advantageous aspect of the method, the calibration device conveys operating parameters for the at least one neural network to the at least one hearing device. The conveying of operating parameters allows the at least one neural network to be customized. The operating parameters can comprise priority parameters for the at least one audio signal separated by using the neural network. The operating parameters can also contain descriptions of individual audio signals that are supposed to be separated from the input signal. If for example many audio signals of the same type are contained in the input signal, the conveyed description allows the at least one neural network to be customized such that only the audio signals that the description contains are separated. By way of example, a neural network specializing in separation of human voices can be adjusted to separate specific voices, for example of the interlocutors of a speaker, by means of the handover of operating parameters. In one instance of application, there may be many different speakers in a room, for example. The description of individual voice profiles of the speakers allows the at least one neural network to be notified of which of the audio signals are supposed to be separated. Further voices that the input signal contains which do not correspond to the descriptions are not separated from the input signal by the neural network customized in this manner. Alternatively, further audio signals that the input signal contains which do not correspond to the descriptions can be combined as a remainder signal. The remainder signal can contain for example voices and/or background noise that are not separated from the input signal. The remainder signal can be output as part of the output signal. The operating parameters are also referred to as vectors.

According to one preferred aspect of the inventive technology, the calibration signal comprises audio data, system parameters of the hearing device system, sensor data and/or user-specific data. The audio data may be for example portions of the input signal recorded by the at least one hearing device. These audio data can be transmitted from the at least one hearing device to the calibration device. Preferably, the audio data are recorded by the calibration device independently of the hearing devices. A transmission of the audio data from the hearing devices to the calibration devices is therefore not necessary. This reduces the latency of the system, in particular the latency of the calibration, further. Additionally or alternatively, the calibration signal can have sensor data, such as for example position data, in particular GPS position data, and/or motion data. The calibration device can further be connected to further sensors and/or comprise further sensors in order to a certain user-specific data and/or system parameters. Exemplary sensors may comprise at least one of the following sensors: position sensors, in particular GPS sensors, accelerometers, temperature sensors, pulse oximeters (photoplethysmographic sensors, PPG sensors), electrocardiographic sensors (ECG or EKG sensors), electroencephalographic sensors (EEG sensors) and electrooculographic sensors (EOG sensors). This can involve for example the location of the user and/or the motion of said user, for example the fact that he is on the road, being ascertained. The user-specific data available are for example known preferences of the user and/or user inputs already made previously. As such, for example it may be saved in the system that the user wants particularly heavy rejection of background music in restaurants. This information can be used to ascertain an applicable priority parameter for background noise. The user-specific data can also include samples of sound sources known to the user. As such, for example speakers known to the user can be saved. If the voice of such a speaker is detected, said voice can automatically be assigned a higher priority parameter. The user-specific data are preferably saved on an internal memory of the calibration device and/or on an external cloud memory.

The calibration signal can also comprise system parameters of the hearing device system, in particular of the calibration device and/or of the at least one hearing device. Exemplary system parameters are the charging capacity of the power supply of the at least one hearing device. If the result of the analysis of the calibration signal is that there is now only low residual charge in the storage battery of the at least one hearing device, a particularly power-saving neural network can be selected. This allows the operating time of the system to be extended when required. Additionally or alternatively, the remaining residual charge in a power supply of the calibration device may also be part of the calibration signal. If for example it is detected that the calibration device will now only have a short storage battery operating time, at least one neural network can be selected that ensures reliable processing of input signals that are as general as possible. A further calibration by the calibration device can then be dispensed with. In particular when the storage battery state of charge is low, the at least one neural network can also be deactivatable by the calibration device. The input signal can be amplified directly when the at least one neural network is deactivated. This allows the storage battery operating time of the hearing device system, in particular of the at least one hearing device, to be extended.

According to a further advantageous aspect of the method, the calibration device records audio data as part of the calibration signal. The audio data recorded by the calibration device are analysed in the form of a calibration input signal. The recording of the calibration input signal has the advantage that audio data, in particular portions of the input signal, do not need to be transmitted from the at least one hearing device to the calibration device for analysis.

According to a further advantageous aspect of the inventive technology, the user can influence the customization and/or replacement of the at least one neural network. By way of example, the user can make inputs by means of a user interface of the calibration device. The user can in particular prioritize the processing of individual audio signals. By way of example, the audio signals that are separated from the calibration input signal can be displayed to the user by means of the user interface. The user can in particular select one of these audio signals and selectively amplify or reject it. The user can for example stipulate the number of audio signals to be separated from the input signal. The user can individually intervene in the calibration of the at least one neural network of the at least one hearing device as required. This provides the user with indirect influence on the signal processing by means of the at least one hearing device. Preferably, the user can also make a selection from different neural networks customized to the same hearing situation. By way of example, different neural networks can perform filtering and/or processing of audio signals to different extents. Different neural networks may also be combined with different sound profiles. By way of example, different neural networks can play back human voices with different clarity and completeness. This allows the user to customize the signal processing to his preferences even better.

Preferably, the user can also use the user interface to rate the performed separation and processing of the audio signals. On the basis of such ratings, the calibration device can customize the calibration of the at least one hearing device, in particular the customization and/or replacement of the at least one neural network, to the preferences of the user even better. The method is adaptive.

Figure 2:
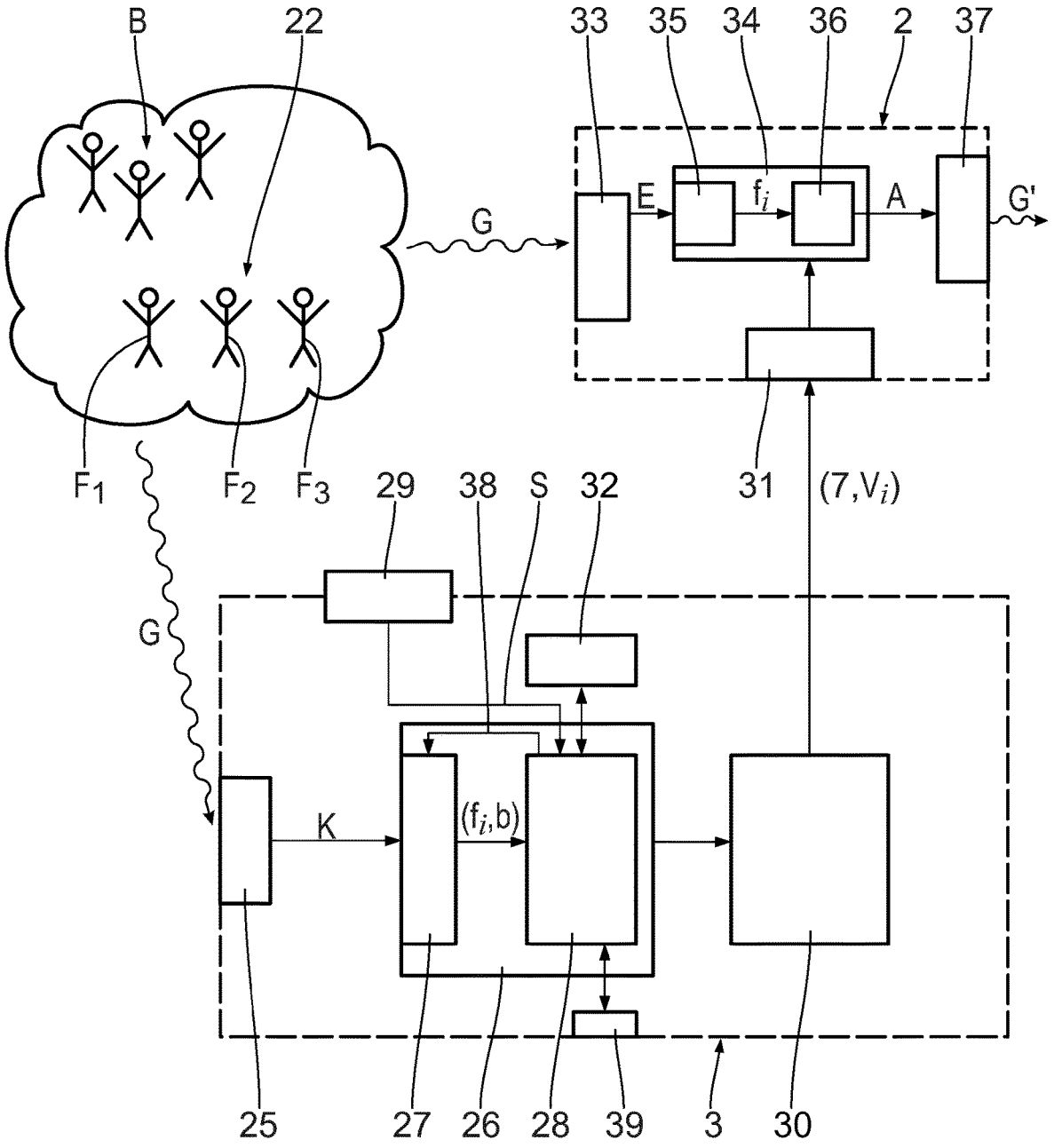

Further details, features and advantages of the inventive technology are obtained from the description of an exemplary embodiment with reference to the figures, in which:

FIG. 1 shows a schematic depiction of a hearing device system for processing audio signals, and FIG. 2 shows a schematic application example along with a method sequence for the processing of audio signals using the hearing device system shown in FIG. 1.

FIG. 1 schematically shows a hearing device system 1 for processing audio signals. The hearing device system 1 has two hearing devices 2 that can be worn on the left and right ears of a user. Additionally, the hearing device system 1 has a calibration device 3. The hearing devices 2 are each connected to the calibration device 3 in a data-transmitting manner by means of a wireless data connection 4. In the present exemplary embodiment, the wireless data connection 4 is a Bluetooth connection. In other exemplary embodiments, the wireless data connection 4 can also be effected by means of another connection standard.

The hearing devices 2 each have a recording device 5 in the form of a microphone. The recording device 5 can be used by the hearing devices 2 to record an input signal E in the form of audio data. The input signal E normally comprises a plurality of audio signals. In addition, the hearing devices 2 each have a playback device 6 in the form of a loudspeaker for playing back an output signal. The hearing devices 2 each have a neural network 7. The neural network 7 is used to separate at least one audio signal from the input signal E. The neural network 7 is an artificial neural network that, in the exemplary embodiment shown, is executed by a computing unit 8 of the respective hearing device 2. The computing unit 8 is not depicted in detail and has a processor, in particular an AI chip, and a main memory.

In addition, the hearing devices 2 each have a data interface 9 for the wireless data connection 4. In the exemplary embodiment shown, the data interface 9 is a Bluetooth antenna. The calibration device 3 also has a corresponding data interface 9.

The hearing devices 2 each have a power supply 10 in the form of a storage battery. The power supply 10 supplies the respective hearing device 2, in particular the recording device 5, the computing unit 8 having the neural network 7, the playback device 6 and the data interface 9, with power for operating the respective hearing device 2.

During operation, the hearing devices 2 perform signal processing. This involves the input signal E being recorded by using the respective recording device 5. The neural network 7 separates at least one audio signal from the input signal E. An output signal A is ascertained from the separated audio signals, said output signal being played back by using the playback device 6. The recording, processing and playback of audio signals is therefore effected in the hearing devices 2 without said audio signals needing to be conveyed to external devices. The latency of the signal processing from recording through to playback is minimized as a result.

The physical properties of the hearing devices 2, in particular the small size thereof, mean that the capacity of the storage battery 10 and the computing power of the computing unit 8 are limited. This limits the processability of the input signal E. In order to allow the high quality of the processing of the input signal E and customization of the output signal A even when the capacity of the storage battery 10 is low and computing power of the computing unit 8 is low, the neural network 7 is customized to the input signal E and/or the audio signals to be separated therefrom. The neural network 7 specialized in this manner can be operated with low computing power and with low power consumption. In order to ensure the specialization for different instances of application, the neural network 7 is customizable and/or replaceable by using the calibration device 3, as will be explained below. The customizability and/or replaceability of the neural network 7 ensures reliable processing of the input signal E even under changing conditions.

The calibration device 3 is a mobile device. In the exemplary embodiment shown, the calibration device 3 is in the form of a mobile phone or smartphone. This means that the calibration device 3 has the hardware of a commercially available mobile phone, software designed for calibrating the hearing devices 2 being installed and executable on the mobile phone. The software can be loaded onto the mobile phone in the form of an app, for example. Established mobile phones have a high level of computing power. Such mobile phones can thus be used to effect complex analysis of a calibration signal. Commercially available mobile phones moreover regularly have an AI chip that can be used to execute neural networks efficiently.

The calibration device 3 has a power supply 11 in the form of a storage battery. Storage batteries of established mobile phones have a charging capacity. The calibration device 3 has a long storage battery operating time.

The calibration device 3 has a calibration recording device 13. The calibration recording device 13 is used to record audio data as a calibration input signal K. The calibration recording device 13 has at least one microphone of the mobile phone. Established mobile phones regularly have multiple microphones. The calibration recording device 13 can make use of a plurality of microphones if need be, in order to record the calibration input signal K using multiple channels, for example as a stereo signal. As a result, in particular spatial information is ascertainable by means of the calibration input signal K.

The calibration device 3 has a signal processing unit 12. By using the signal processing device 12, a calibration signal, in particular the calibration input signal K, is analysable, as will be described in detail below. On the basis of the analysis of the calibration input signal K, the calibration device 3 ascertains the neural network 7, and/or the operating parameters thereof, most suited to processing the input signal E. The neural network 7 and the operating parameters thereof are conveyed to the hearing devices 2 by the calibration device 3 by means of the wireless data connection 4.

The calibration device 3 has a data memory 14. The data memory 14 stores a multiplicity of different neural networks 7, 7*a*, 7*b*, three of which are shown in exemplary fashion in FIG. 1. The different neural networks 7, 7*a*, 7*b* specialize in different input signals E and/or in different audio signals to be separated therefrom. The neural network 7 ascertained by using the analysis of the calibration input signal K is loaded from the data memory 14 and conveyed to the hearing devices 2 by means of the wireless data connection 4 by using the data interface 9.

By means of the customization and/or selection of the neural network 7, it is in particular influenceable which audio signals are separated from the input signal E. By way of example, a neural network 7 may specialize in detecting human voices and separating them from the audio signal. The neural network 7 may additionally or alternatively also specialize in the respective type of input signal. By way of example, different neural networks 7 can be used for separating human voices in a restaurant or when on the road. The operating parameters can be used to stipulate the selection of the audio signals to be separated even more accurately. By way of example, a description of three specific voices of speakers with whom the user is conversing can be handed over to the hearing devices 2 as part of the operating parameters. From a large set of human voices, the neural network 7 then separates only those voices that are accordant with the description handed over. The operating parameters can also be used to perform prioritization for the audio signals separated from the input signal E. As such, it is possible to stipulate for example that individual audio signals are amplified or rejected.

The signal processing unit 12 is moreover connected to further sensors 15 of the mobile phone. Exemplary sensors are GPS sensors and/or motion sensors. The sensor data S ascertained by the sensors 15 are useable in addition or as alternative to the calibration input signal K as calibration signals for analysing and ascertaining the best-suited neural network 7 and the operating parameters thereof.

The analysis of the calibration input signal K and/or the sensor data S can be effected in different ways by using the signal processing unit 12. The specific type of analysis is not significant for the functional separation of calibration and signal processing. In the exemplary embodiment depicted, the signal processing unit 12 has at least one neural calibration network 16. The signal processing unit 12 has a computing unit, not shown more specifically, of the mobile phone. The signal processing unit 12 has an AI chip, in particular. The AI chip has for example two, in particular five, teraflops. The neural calibration network 16 is used to separate individual audio signals from the calibration input signal K. As a result, the calibration input signal K and in particular the audio signals contained therein that are relevant to the user are ascertainable. It is therefore possible for the neural network 7 best suited to separation by using the hearing device 2 to be ascertained on the basis of the analysis of the calibration input signal K that is performed by said neural network.

The signal processing unit 12 also has a user interface 17 connected to it. In the case of the calibration device 3 in the form of a mobile phone, the user interface 17 is formed by a touchscreen. The user interface 17 can be used to display information about the hearing device system 1, in particular about the audio signals separated from the calibration input signal K, to the user. The user can use the user interface 17 to influence the replacement and/or customization of the neural network 7 by the calibration device 3. Depending on user inputs, for example other operating parameters and/or another of the neural networks 7, 7*a*, 7*b* can be conveyed to the hearing devices 2 in order to ensure signal processing by the hearing devices 2 that is consistent with the user preferences.

User-specific data 18 resulting from earlier user inputs and/or previously analysed calibration input signals K can be stored in the data memory 14. The signal processing unit 12 can save the user-specific data 18 on the data memory 14 and retrieve and analyse them as part of the calibration signal. User-specific data 18 can contain for example information pertaining to preferences and/or needs of the user, for example a preset that specific types of audio signals are supposed to be amplified or rejected.

The calibration device 3 has a further data interface 19. The data interface 19 is used to make a data connection 20 to an external memory 21. The external memory 21 can be a cloud memory. The data interface 19 is in particular a mobile phone network or W-LAN data interface. The cloud memory 21 can be used to mirror the data from the data memory 14. This has the advantage that the user can replace the calibration device 3 without the user-specific data 18 being lost. A further advantage of the connection to the cloud memory 21 is that the cloud memory 21 can also be used to store an even larger number of neural networks 7, 7*a*, 7*b*, so that neural networks 7, 7*a*, 7*b* optimally customized to the situation can be loaded onto the hearing devices 2 by means of the calibration device 3 as required. The data interface 19 can also be used to load updates for the hearing device system 1, in particular the calibration device 3 and the hearing devices 2.

Referring to FIG. 2, an application example of the hearing device system 1 is schematically depicted. In the depicted application example, the user is with three friends $F_i$, where i=1, 2, 3 denotes the respective friends, in a restaurant 22. Further guests B are present in the restaurant 22 and contribute to a background noise b of the soundscape G in the restaurant 22.

The steps used when using the hearing device system 1 are discussed below. In this case, the steps are associated with the calibration device 3 and the hearing devices 2. For clarification purposes, the respective devices are indicated as dashed borders around the respective associated method steps. First of all, a calibration recording step 25 involves the soundscape G of the restaurant 22 being recorded as a calibration input signal K by using the calibration recording device 13 and being handed over to the signal processing device 12. The soundscape G and hence also the calibration input signal K normally comprises an unknown number of different audio signals. In the exemplary embodiment shown, the calibration input signal K comprises the spoken voice $f_i$ associated with the three friends $F_i$ and also the background noise b.

The signal processing device 12 is used to analyse the calibration input signal K in an analysis step 26. To this end, a calibration separation step 27 first of all involves multiple audio signals that the calibration input signal K contains being separated from the latter. In the exemplary embodiment depicted, the voice data $f_i$ associated with the friends $F_i$ and the background noise b corresponding to a remainder signal are separated from the calibration input signal K. The separation is effected in the calibration separation step 27 by using the at least one neural calibration network 16.

The calibration separation step 27 can comprise a preparation step, not depicted more specifically, for conditioning the calibration input signal K. The preparation step can comprise conventional conditioning, for example. The conventional conditioning can involve for example direction information ascertained on the basis of multiple microphones being ascertained and used for normalizing the sounds. Moreover, the preparation step can involve a first neural calibration network being used to condition the calibration input signal K. An exemplary preparation step can be consistent for example with the preparation step described with reference to FIG. 3 in DE 10 2019 200 954.9 and DE 10 2019 200 956.5.

The conditioned calibration input signal K can be broken down into individual audio signals by a second neural calibration network in a particularly simple and efficient manner, for example. The actual separation following the preparation step can be effected using one or more second neural calibration networks. Different second neural calibration networks may be customized for separating different audio signals. Separation using multiple second neural calibration networks can be effected for example as described with reference to FIG. 4 in DE 10 2019 200 954.9 and DE 10 2019 200 956.5.

The calibration separation step 27 is followed by a classification step 28. The classification step 28 involves the audio signals $f_i$, b separated from the calibration input signal K being evaluated. On the basis of the evaluation, the calibration device 3 detects that the user is in the restaurant. The classification step 28 can therefore limit the selection of available neural networks 7, 7*a*, 7*b* to networks specializing in the separation of audio signals from a soundscape typical of restaurants.

The classification step can alternatively or additionally also involve sensor data S ascertained in a sensor reading step 29 being used. By way of example, the GPS position of the user can be used to ascertain the presence of said user in the restaurant 22. The motion profile of the user can be used to detect that said user is not moving, that is to say is staying in the restaurant. Furthermore, it is also possible for other location-specific data, such as for example a W-LAN access point associated with the restaurant 22, to be used for determining the whereabouts of the user and for selecting the suitable neural network 7 from the available set of neural networks 7, 7*a*, 7*b*.

To determine the neural network 7 to be used, the audio signals $f_i$, b separated from the calibration input signal K are moreover analysed and matched to user preferences and/or user specifications. By way of example, the audio signals $f_i$ corresponding to the friends $F_i$ can be identified as speakers known to the user. To this end, the applicable audio signals $f_i$ can be matched to against voice signals already detected and used previously. The speakers known to the user may be stored as user-specific data in the data memory 14 and/or the cloud memory 21 and can be matched to the separated audio signals $f_i$ in a data matching step 32. In the classification step 28, the system therefore automatically detects the audio signals $f_i$ important to the user. The system can therefore automatically detect that a neural network 7 is needed that can separate three audio signals corresponding to the voices of the friends $F_i$ from the soundscape G typical of restaurants.

The analysis step 26 is followed by a calibration step 30. The calibration step 30 involves the neural network 7 ascertained on the basis of the evaluation of the calibration input signal K being loaded from the data memory 14 or from the cloud memory 21 and transmitted from the calibration device 3 to each of the hearing devices 2. The neural network 7 is also used to transmit operating parameters $V_i$, which are also referred to as vectors, to the hearing devices 2. The neural network 7 and the operating parameters $V_i$ together form a transmission signal (7, $V_i$) that is transmitted from the calibration device 3 to the hearing devices 2. The operating parameters $V_i$ convey information pertaining to each of the audio signals to be subsequently separated by means of the neural network 7. In the instance of application depicted, the vectors $V_i$ each contain a description of the voice of the applicable friend $F_i$ and an associated priority parameter. The description of the respective voices is used to ensure that the neural network separates only the voices of the friends and not the voices of other restaurant guests B from the soundscape G. The respective priority parameters indicate the factor by which the respective audio data $f_i$ are each supposed to be amplified.

The neural network 7 transmitted to the hearing devices 2 in the calibration step 30 is initiated in the hearing devices 2 on the basis of the operating parameters $V_i$ by using an initiation step 31.

Following the initiation of the neural network 7 using the operating parameters $V_i$, the signal processing can be effected by using the hearing devices 2. Using the computing power of established AI chips, the hearing devices 2 can start the signal processing by means of the calibration device 3 within a short time after the provision of the calibration signal, in particular after the recording of the calibration input signal K. The period of time for the initiation is dependent in particular on whether the at least one neural network 7 is customized or replaced. If only operating parameters $V_i$ for customizing the neural network 7 are transmitted to the hearing devices 2, this can take place for example in particular within 1 s, in particular within 750 ms, in particular within 500 ms, in particular within 350 ms. When the neural network 7 is replaced, the new network needs to be transmitted, which is possible for example within 2 ms, within 900 ms, in particular within 800 ms, in particular within 750 ms.

The signal processing proceeds independently in each of the hearing devices 2. In a recording step 33, the respective soundscape G is recorded in the form of the input signal E by using the recording device 5. The input signal E is forwarded to the computing unit 8, where it is processed in a processing step 34. In the processing step 34, the audio signals $f_i$ corresponding to the friends $F_i$ are first of all separated from the input signal E in a separation step 35 by using the neural network 7. The separated audio signals $f_i$ are subsequently modulated in a modulation step 36 on the basis of the priority parameters handed over with the operating parameters $V_i$. In this case, the audio signals $f_i$ are amplified or rejected according to the preferences of the user. The modulated audio signals $f_i$ are combined in the modulation step 36 to produce an output signal A. The output signal A is forwarded to the playback device 6. The playback device 6 plays back the output signal for the user in the form of a sound output G' in a playback step 37.

Following the calibration by the calibration device 3, the signal processing is effected entirely on the hearing devices 2. The recording, processing and playback are effected by using the hearing devices 2 and hence without perceptible latency for the user.

The further signal processing can be effected by the hearing devices 2 independently of the calibration device 3. The calibration device 3 can be used to perform further customizations of the neural network 7, however, and/or also to replace the neural network 7 used for the separation step 35. In particular, the calibration is checked and, if need be, customized at regular intervals by virtue of the neural network 7 being replaced and/or customized by the calibration device 3.

In parallel with the signal processing by the hearing devices 2, the calibration device 3 can furthermore record a calibration input signal K in the calibration recording step 25 and analyse it by using the analysis step 26. This allows the accuracy of the analysis and hence of the selection and/or customization of the neural network 7 to be increased. By way of example, the calibration separation step 27 can be customized to the results of the classification step 28 by a classification feedback loop 38. This allows the at least one neural calibration network 16 used in the calibration separation step 27 to be customized to the results of the classification step 28. If the classification step 28 recognizes surroundings of the user, for example on the basis of the sensor data S and/or the audio signals separated from the calibration input signal K, the at least one neural calibration network 16 can be customized to the user surroundings and the soundscape to be expected therein. As such, it is possible for neural calibration networks 16 customized to different situations to be used, for example. In the application example depicted in FIG. 2, it is possible for a neural calibration network 16 optimized for the detection of human voices to be used, for example. The neural calibration network 16 specializing in human voices can be used to separate and distinguish human voices even better. This firstly ensures that the audio signals $f_i$ corresponding to the friends $F_i$ are separated from the calibration input signal K. Secondly, other voices are also taken into consideration. By way of example, the voice of a waiter can be separated. What is said by the waiter can be categorized as relevant to the user on the basis of an analysis of a transcription of the applicable audio signal and/or of a match with the audio signals $f_i$, for example from the applicable pauses in speech. In this case, a neural network 7 that can separate four human speakers, namely the waiter and the friends $F_i$, from the input signal E would be needed for the separation by using the hearing devices. An applicable neural network 7 can then be sent to the hearing devices 2 with applicable operating parameters $V_i$ in order to replace the neural network 7 currently being used on said hearing devices. The calibration device 3 can also replace the neural network 7 in the course of the signal processing by the hearing device 2. Alternatively or additionally, it is also possible for the operating parameters $V_i$ to be customized in the course of the signal processing by the hearing devices 2. For the example of a waiter approaching the table, a vector V, describing the voice of the waiter, that has an appropriately high priority parameter can be conveyed to the hearing device 2 in order to ensure that the words of the waiter are also correctly understood. Additionally, a transcript of what is said can be displayed on the display of the mobile phone 3. The user can then read words that he may not have understood.

Moreover, the operating parameters $V_i$ can be customized or the neural network 7 can be replaced on the basis of user inputs in a user input step 39. The user inputs can be made by using the user interface 17. By way of example, the user can influence the modulation of the signals as a whole. Moreover, the audio signals $f_i$, b ascertained in the analysis step 26 can be displayed to the user by means of the user interface 17. The user can deliberately select individual instances of the audio signals $f_i$, b in the user input step 39 in order to initiate the separation of said audio signals by using the neural network 7 and/or to influence the modulation of said audio signals.

Replacement of the neural network 7 is necessary in particular when the input signal E changes. If for example the sensor data S ascertained in the sensor reading step 29 are used to detect that the user is leaving the restaurant 22, replacement of the neural network 7 may be called for. By way of example, the user can exit the restaurant 22 onto the street. In this case, a neural network 7 specializing in road noise can be selected and conveyed to the hearing devices 2. This ensures that audio signals from vehicles, for example approaching cars, are separated from the input signal E and played back for the user as part of the output signal A.

In other instances of application, it is also possible for more than one neural network 7 to be handed over to the hearing devices 2. For example, when the user leaves the restaurant together with his friends $F_i$. In this case, separation of both the audio signals $f_i$ of the friends $F_i$ and audio signals from other road users, for example approaching vehicles, may be called for. In such an instance of application, two neural networks 7 can be handed over to the hearing devices 2 in order to be able to separate and process a larger number of audio signals. One of the neural networks 7 can specialize in the separation of approaching vehicles from an input signal E typical of road traffic. The second neural network 7 can specialize in the separation of human voices from the input signal E typical of road traffic. In this case, the audio signals relevant to the user can be separated from the input signal E with low computational and power consumption.

In yet other instances of application, the calibration device 3 can also temporally deactivate the neural network 7 of the hearing devices 2. If the user is with his friends $F_i$ in otherwise quiet surroundings, for example, the input signal E corresponds substantially to the audio signals $f_i$. Separation and/or amplification of the audio signals $f_i$ from the input signal E is therefore not necessary. When the neural network 7 is deactivated, the output signal A is determined from the input signal E by amplifying the latter directly. This is possible with low computational complexity and low power consumption. As soon as further sounds are added to the audio signals $f_i$, i.e. the hearing situation becomes more complex, the calibration device can detect this and automatically reactivate the neural network 7 of the hearing devices 2. In this case, the neural network 7 can be customized and/or replaced in order to calibrate the hearing devices 2.

In yet another instance of application, the neural network 7 can also be deactivated by the calibration device 3 if a state of charge of the power supply 10 of the hearing devices 2 is below a predetermined limit value. This allows use of the hearing devices 2 to be ensured for a longer period of time even when the state of charge of the power supply 10 is low.

In the instances of application described above, the number of audio signals to be separated from the input signal E is automatically stipulated by the calibration device 3. By using the user interface 17, the user can additionally manually stipulate the number of audio signals to be separated. The user can display the audio signals separated from the calibration input signal K by means of the user interface, i.e. on the display of the calibration device 3. The user can then select individual audio signals to be separated. Alternatively, the user can use an appropriate controller to stipulate the number of audio signals to be separated. The calibration device 3 then selects the applicable number of audio signals in accordance with the respective relevance ascertained by means of the analysis of the calibration input signal.

In a further exemplary embodiment, which is not depicted, the computing unit of the at least one hearing device comprises an application-specific integrated circuit (ASIC) for executing the at least one neural network. The computing unit is optimally customized to perform a respective neural network. The neural network can be executed particularly efficiently as a result. The network is customizable to the respective instance of application, in particular the number and type of audio signals to be separated from the input signal, however, as a result of the vectors calculated by using the calibration unit being handed over. The customization is effected by virtue of the weighting within the network being customized. In some exemplary embodiments in which the computing unit of the at least one hearing device is embodied as an application-specific integrated circuit, the at least one neural network can be nonreplaceable.

In a further exemplary embodiment, which is not depicted, a hearing device system comprises no external, wearable hearing devices but rather at least one implantable hearing device. In one exemplary embodiment, the at least one hearing device can be a cochlear implant. In further exemplary embodiments, the at least one hearing device is a different implant, for example a middle-ear implant or a brain stem implant.

The invention claimed is:

1. A hearing device system for processing audio signals, the hearing device system having at least one hearing device comprising:

a recording device for recording an input signal;

at least one neural network for separating at least one audio signal from the input signal; and a playback device for playing back an output signal ascertained from the at least one audio signal; and a calibration device connected to the at least one hearing device in a data-transmitting manner, wherein:

the at least one neural network is replaceable by the calibration device; and the calibration device has at least one neural calibration network for analyzing a calibration signal.

2. The hearing device system according to claim 1, wherein the replacement of the at least one neural network renders a structure of the at least one neural network as customizable.

3. The hearing device system according to claim 1, wherein the calibration device and the at least one hearing device are connected by means of a wireless data connection.

4. The hearing device system according to claim 1, wherein the calibration device is included as part of a mobile phone or part of a wireless microphone.

5. The hearing device system according to claim 1, wherein the at least one neural network is selectable from a plurality of different neural networks by means of the calibration device.

6. The hearing device system according to claim 5, wherein neural networks included in the plurality of different neural networks are transmittable from the calibration device to the at least one hearing device.

7. The hearing device system according to claim 1, wherein the calibration device has a calibration recording device for recording audio data as part of the calibration signal.

8. The hearing device system according to claim 1, wherein the calibration device has a user interface for receiving at least one of user inputs or for outputting information to a user.

9. A method for processing audio signals, the method having the steps of:

providing a hearing device system having at least one hearing device having at least one neural network for separating at least one audio signal from an input signal, and a calibration device connected to the at least one hearing device in a data-transmitting manner;

providing a calibration signal;

analyzing the calibration signal by means of the calibration device;

at least one of replacing or customizing the at least one neural network of the at least one hearing device by means of the calibration device on the basis of the analyzed calibration signal;

recording an input signal by using a recording device of the at least one hearing device;

separating at least one audio signal from the input signal by using the at least one neural network of the at least one hearing device;

ascertaining an output signal from the at least one audio signal; and outputting the output signal by using a playback device of the at least one hearing device.

10. The method according to claim 9, wherein the analysis of the calibration signal is effected by using at least one neural calibration network.

11. The method according to claim 9, wherein the calibration device selects the at least one neural network from a plurality of available neural networks.

12. The method according to claim 11, wherein the selected neural network is transmitted from the calibration device to the at least one hearing device.

13. The method according to claim 9, wherein the calibration device conveys operating parameters for the at least one neural network to the at least one hearing device.

14. The method according to claim 9, wherein the calibration signal comprises at least one of audio data, sensor data, user-specific data or system parameters of the hearing device system.

15. The method according to claim 9, wherein the calibration device records audio data as part of the calibration signal.

16. The method according to claim 9, wherein user can influence the at least one of the replacing or the customization of the at least one neural network.

* * * * *